US006270376B1

(12) United States Patent
Fink et al.

(10) Patent No.: US 6,270,376 B1
(45) **Date of Patent: *Aug. 7, 2001**

(54) PRE-STAGED DUAL LOCK MULTI-ROW ELECTRICAL CONNECTION SYSTEM

(75) Inventors: Randy L. Fink, Warren, OH (US); Robert W. Rimko, Transfer, PA (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/302,892

(22) Filed: Apr. 30, 1999

Related U.S. Application Data

(63) Continuation-in-part of application No. 09/252,700, filed on Feb. 18, 1999.
(60) Provisional application No. 60/075,268, filed on Feb. 19, 1998.

(51) Int. Cl.[7] ..... H01R 13/422
(52) U.S. Cl. ..... 439/595; 439/752
(58) Field of Search ..... 439/752, 595

(56) References Cited

U.S. PATENT DOCUMENTS 5,775,957 * 7/1998 Fink et al. ..... 439/752
6,171,146 1/2001 Fink et al. ..... 439/595

* cited by examiner

*Primary Examiner*—Gary F. Paumen
(74) *Attorney, Agent, or Firm*—Richard A. Jones

(57) ABSTRACT

A pre-staged electrical connector system including mutually seatable first and second connector halves. A female terminal retainer is seated in the first connector half, having a front face, a rear face and a plurality of terminal cavities for each receiving a portion of a terminal, wherein the terminal has an annular abutment. A plurality of flexible locking fingers extend from the front face, each straddling two adjacent terminal cavities. Each flexible locking finger includes a pair of spaced apart locking shoulders, one for each straddled terminal cavity, each locking shoulder having a terminus. When the female terminal is passed into a terminal cavity from the rear face, the terminus of the locking shoulder thereat interferingly abuts the terminal abutment, thereby preventing rearward withdrawal of the female terminal through the rear face. A secondary lock system is provided wherein at least one arm is positioned on at least one groove of the terminal retainer so as to abut the terminal abutment of any terminals received into the terminal retainer. A slide assist system is provided for assisting seating of the first and second connector halves, wherein a first pre-stage retains the first connector half configured for initial seatin, thereinto by the second connector half, and wherein at a second pre-stage, the first and second connector halves are intermediately seated, mutually held together, and the slide assist system is operable to provide full seating of the first and second connector halves.

21 Claims, 10 Drawing Sheets

PRE-STAGED DUAL LOCK MULTI-ROW ELECTRICAL CONNECTION SYSTEM

TECHNICAL FIELD

The present invention is a continuation-in-part application of now pending patent application Ser. No. 09/252,700, filed Feb. 18, 1999, which is a continuation-in-part application of now abandoned provisional patent application serial number 60/075,268, filed on Feb. 19, 1998.

BACKGROUND OF THE INVENTION

1. Field of the Invention

This invention relates to electrical connector systems, particularly to electrical connector systems utilizing female terminal retainers. More particularly, the present invention relates to a connector system featuring a high density terminal distribution wherein each pair of female terminals is held in position, respectively, by a flexible locking arm associated with the female terminal retainer.

2. Description of the Related Art

Electrical connector systems are known to include female terminal retainers including a plurality of rows and coltimns of cavities each for receiving a female terminal therein. However, in these prior art devices, each terminal includes its own lock mechanism to retain the female terminal and its associated cavity. As a result, the distance between rows of terminals carried in the retainers has heretofore been substantially large and greater than 2.54 mm.

The present invention provides alternatives to and advantages over the prior art.

SUMMARY OF THE INVENTION

The present invention is an electrical connector system including a female terminal retainer. The female terminal retainer preferably has a block like configuration, including a front face, an opposite rear face and a plurality of terminal cavities extending therethrough from the rear face to the front face arranged in a plurality of rows and a plurality of columns. Each terminal cavity is constructed and arranged to receive a portion of an electrical terminal.

In this regard, a female terminal configured to cooperate with the female terminal retainer is characterized by a first portion having a cylindrical sidewall of a first cross-section, wherein the cylindrical sidewall defines a cylindrical cavity for receiving therein a male terminal at its forward, open end. The female terminal further is characterized by a second portion having a reduced cross-section distally located with respect to the forward end, wherein an annular terminal abutment is formed at the interface between the two dissimilar crosssections of the first and second portions.

In order to retain the female terminals in their respective terminal cavities, flexible locking fingers are provided which extend from the front face of the female terminal retainer, wherein each locking finger is positioned to straddle two mutually adjacent terminal cavities. Each flexible locking finger includes a pair of spaced apart locking shoulders at the terminal portion thereof. Each locking shoulder has an intrusive surface which is disposed into a portion of a respective terminal cavity which includes the shoulder terminus.

Accordingly, provided is a primary terminal lock system, wherein when a female terminal is inserted into its respective terminal cavity commencing at the rear face, the cylindrical sidewall of the first portion pushes upon the intrusive surface with attendant resilient deformation of the locking finger until the second portion is reached, whereupon the locking finger resiliently relaxes and the terminus of the locking shoulder now interferingly engages the terminal abutment, thereby preventing rearward withdrawal of the female terminal through the rear face of the female terminal retainer.

In the preferred embodiment, the plurality of rows and columns of terminal cavities are composed of first, second, third, and forth rows, each row having a plurality of columns (as for example sixteen). The female terminal retainer includes first, second and third sets of locking fingers. The first set of locking fingers is characterized by each locking finger thereof straddling a pair of mutually adjacent terminal cavities at every second columnar position of the first row. The second set of locking fingers is characterized by each locking finger thereof straddling a pair of terminal cavities of the second and third rows having the same columnar position. The third set of locking fingers is characterized, by each locking finger thereof straddling a pair of mutually adjacent terminal cavities of every second columnar position of the fourth row.

The female terminal retainer is received into a female connector housing having a plurality of cavities, each being aligned with a respective terminal cavity. A plurality of access ports are provided in the female connector housing, wherein each access port straddles a respective pair of terminal cavities which are, in turn, straddled by a locking finger.

Another feature of the present invention is a secondary terminal lock feature in the form of a U-shaped secondary lock member, which is slidably placed across the front face of the female terminal retainer so that the two mutually parallel lock arms thereof interferingly engage simultaneously the terminal abutment of the female terminals at all four of the rows and at all columnar positions of each row.

Another feature of the present invention is a first connector half (including the female terminal retainer and the female connector housing), a second connector half carrying male terminals for engagement with the female terminals, and a slide assist system for seating the second connector half into the first connector half. A pair of slide assist members slidably mounted in the first connector half have inclined grooves which receive bosses of the second connector half A slide assist lever is pivotally mounted to the first connector half, wherein pivoting thereof causes the slide assist members to slide and the bosses to advance in the grooves, thereby causing the second connector half to become fully seated into the first connector half.

Yet another feature of the present invention is pre-staging. At a first pre-stage, a resilient locking arm of each of the slide assist members interferingly abut a respective perimeter of a slot of the first connector half, thereby preventing the slide assist lever from pivoting out of its first (pre-staged) position. A second pre-stage is defined when the second connector half is intermediately inserted into the first connector half such that a pair of nibs on the second connector half become engaged on lips of the first connector half, whereupon the second connector half is heldably received into the first connector half. At the second pre-stage, tabs of the second connector half press upon the locking arms, causing the locking arms to flex out of interfering abutment with the slot perimeter, whereby the slide assist lever may now be pivoted.

Accordingly, it is an object of the present invention to provide a high terminal density electrical connector.

It is an additional object of the present invention to provide a high terminal density electrical connector, wherein each pair of terminals is locked in position by a respective resilient locking finger.

It is a further object of the present invention to provide first and second connector halves which are pre-staged relative to each other, wherein each pair of terminals of the first connector is locked in position by a respective resilient locking finger, wherein all the terminals are locked in position collectively by a secondary lock member.

These and other objects, features, and advantages of present invention become apparent from the following brief description of the drawings, detailed description, and appended claims and drawings.

DESCRIPTION OF THE PREFERRED EMBODIMENT

Figure 12:
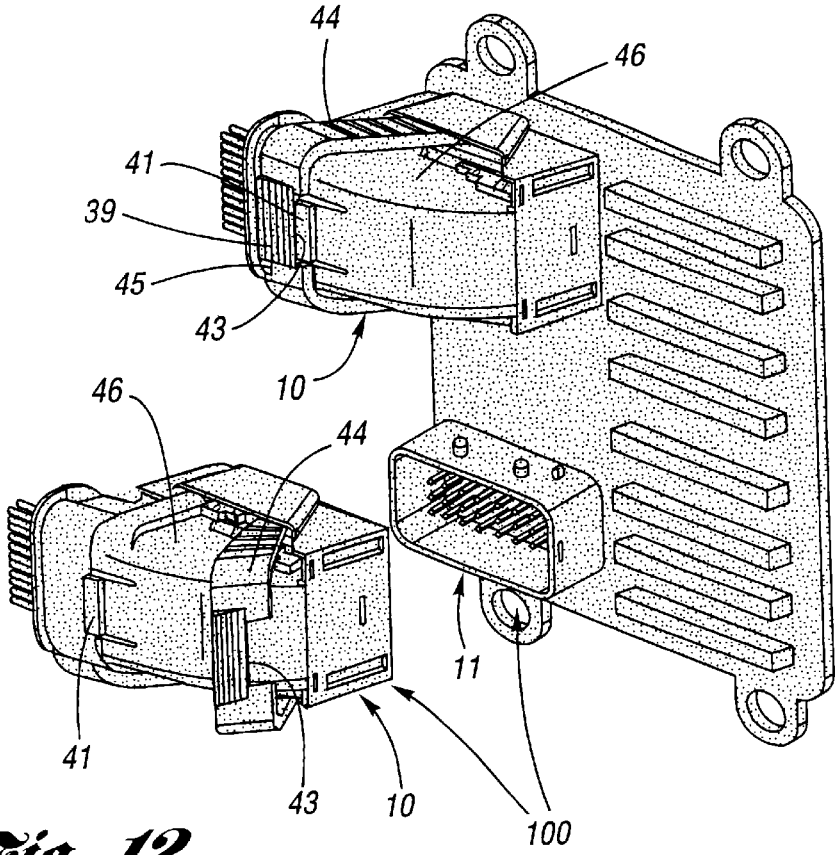
FIG. 12 is a side view of the first and second connector halves of the electrical connector system according to the present invention.

Referring firstly to FIG. 12, an electrical connector system 100 according to the present invention is depicted in which a preferably plastic first connector half 10 mates with a preferably plastic second connector half 11 for the purposes of electrically connecting discretely arranged male and female electrical terminals matably to each other, the nature of which will be detailed hereinbelow. The genders of the electrical terminals as these pertain to the first and second connector halves will be described herein by preferred example, it being understood that the genders can be reversed.

Figure 1:
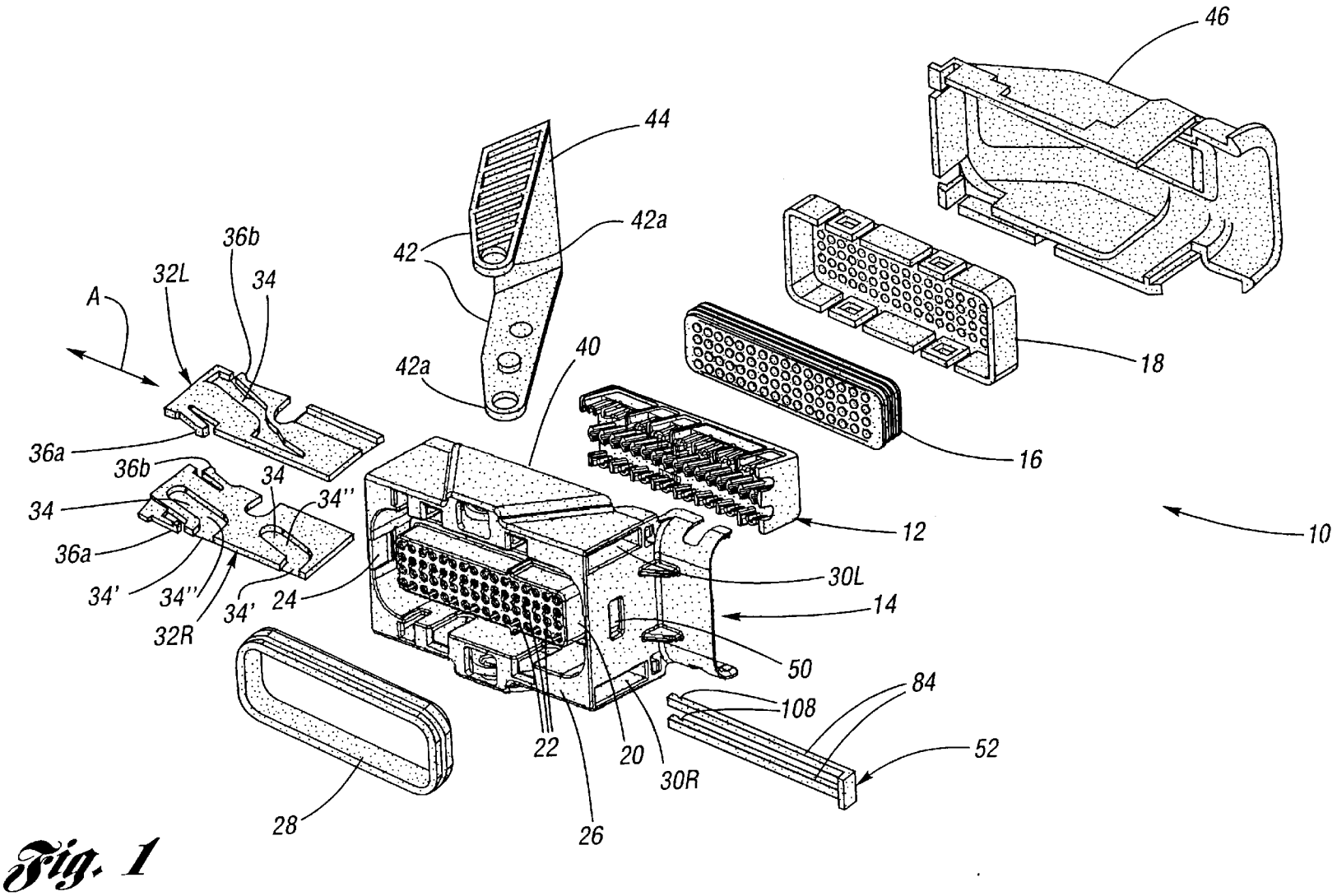
FIG. 1 is an exploded perspective view of a first connector half of the electrical connector system according to be present invention.
Figure 2:
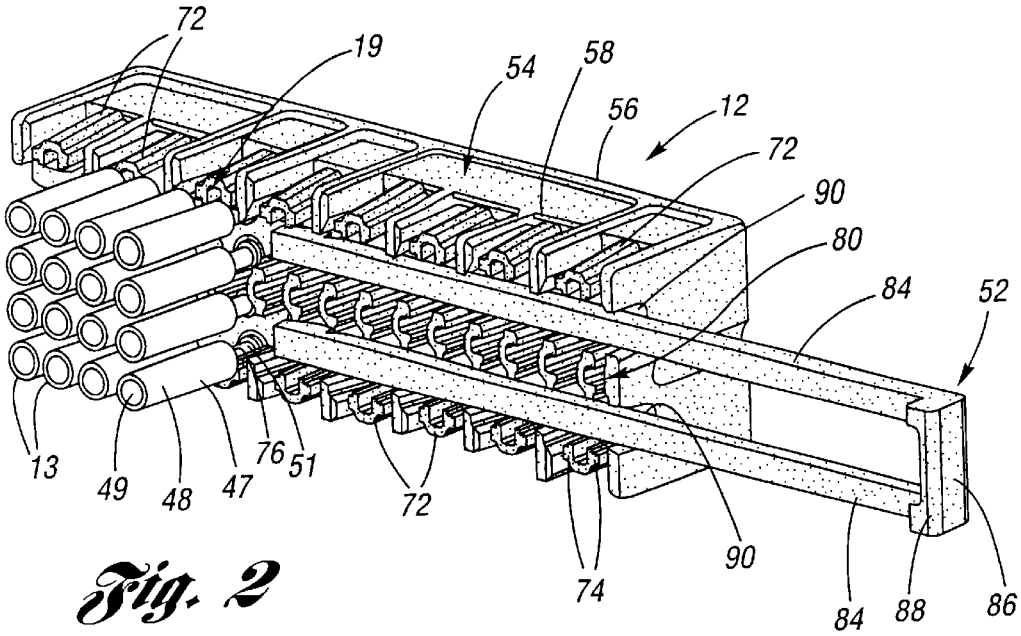
FIG. 2 is a perspective view of a female terminal retainer according to the present invention, shown in operation with respect to a plurality f female terminals and a secondary lock member.
Figure 3:
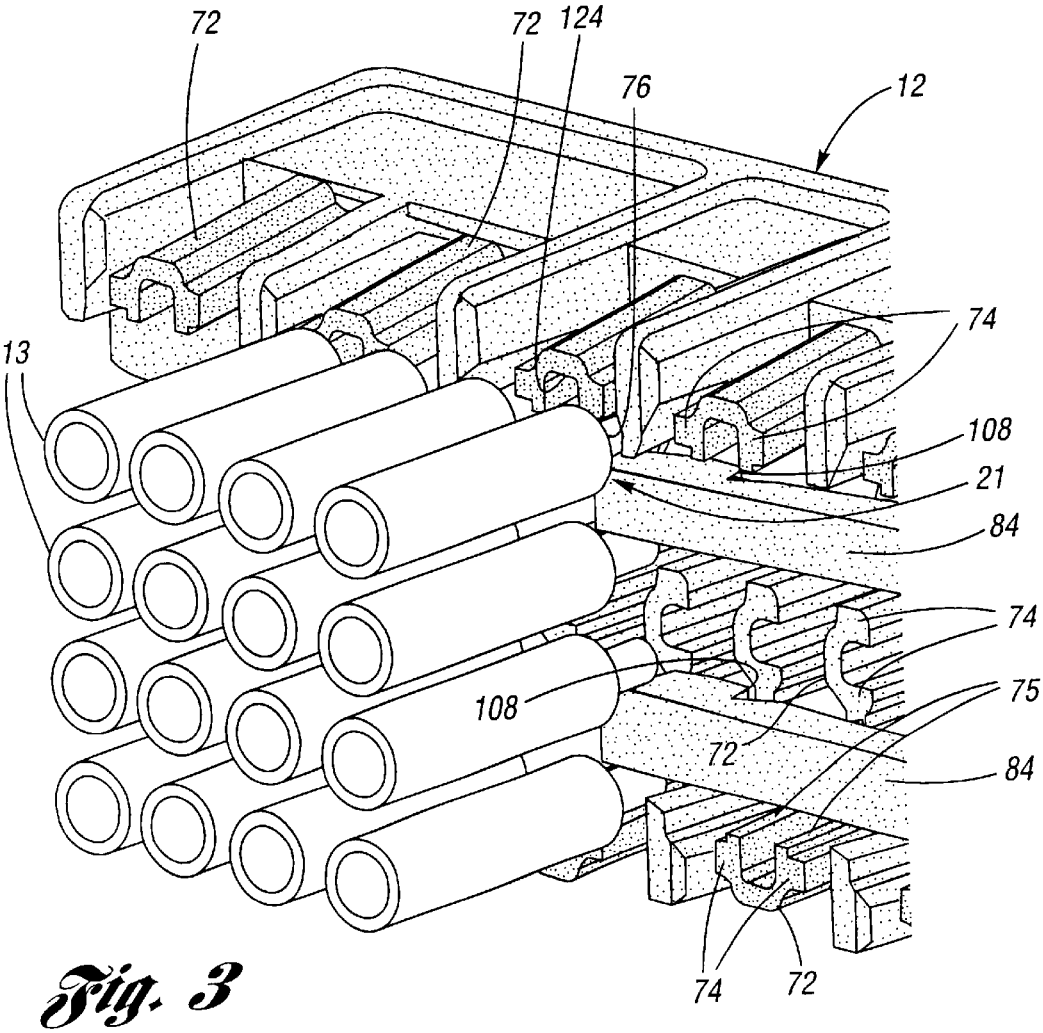
FIG. 3 is enlarged view of the female terminal retainer as seen at FIG. 2.
Figure 6:
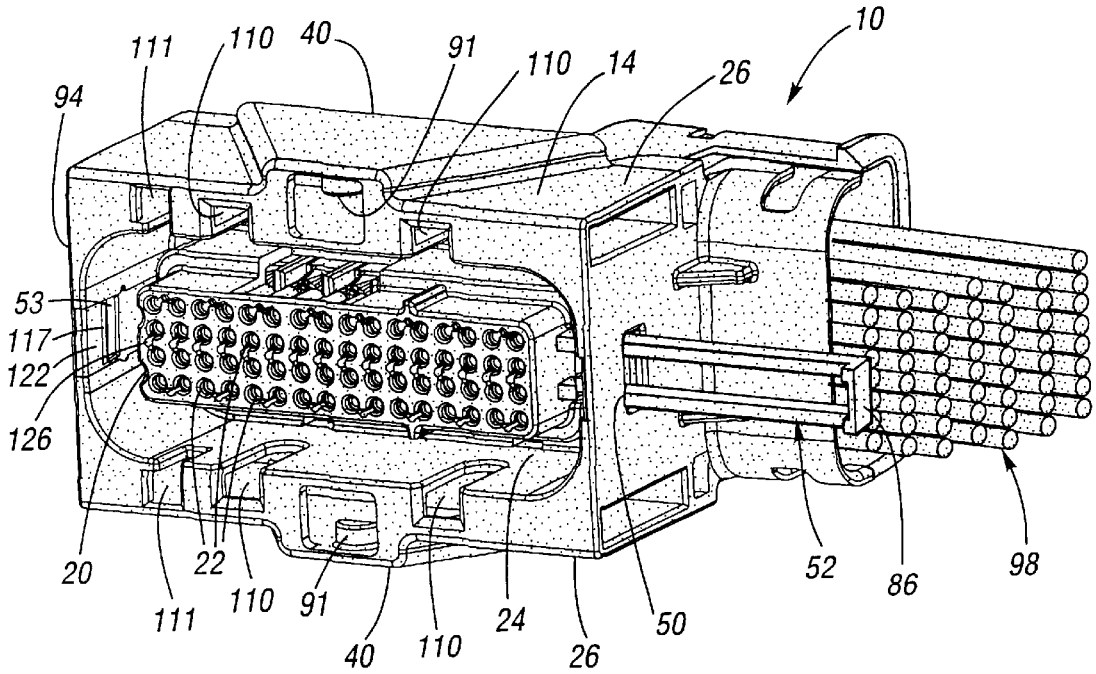
FIGS. 6 and 7 are perspective views illustrating a sequence of steps for installing the secondary lock member into the first connector half
Figure 7:
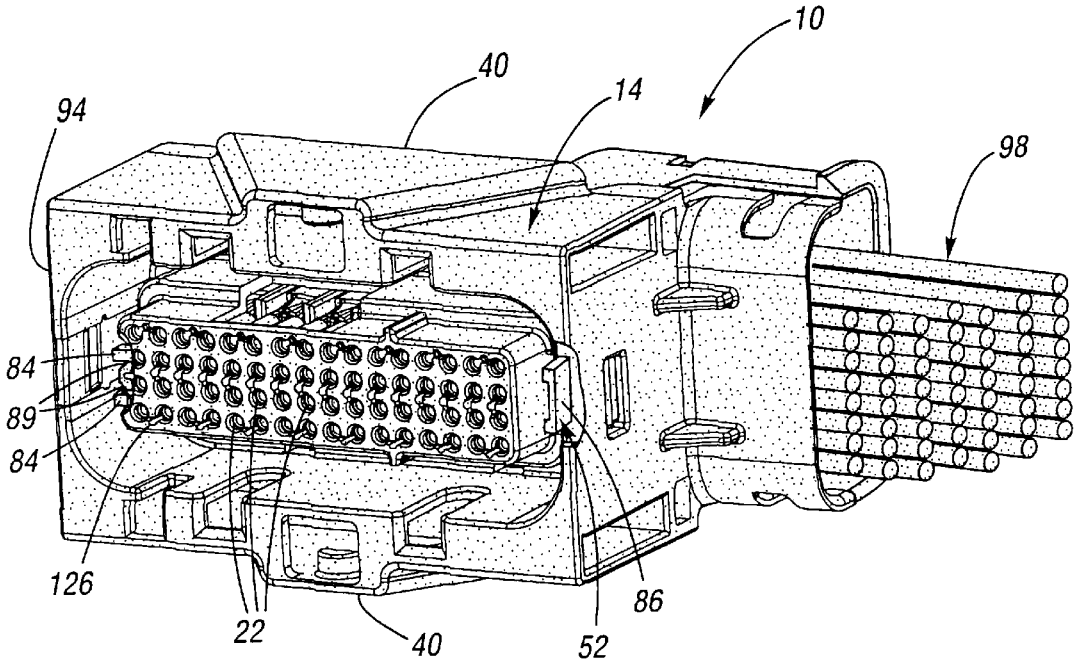
Figure 8:
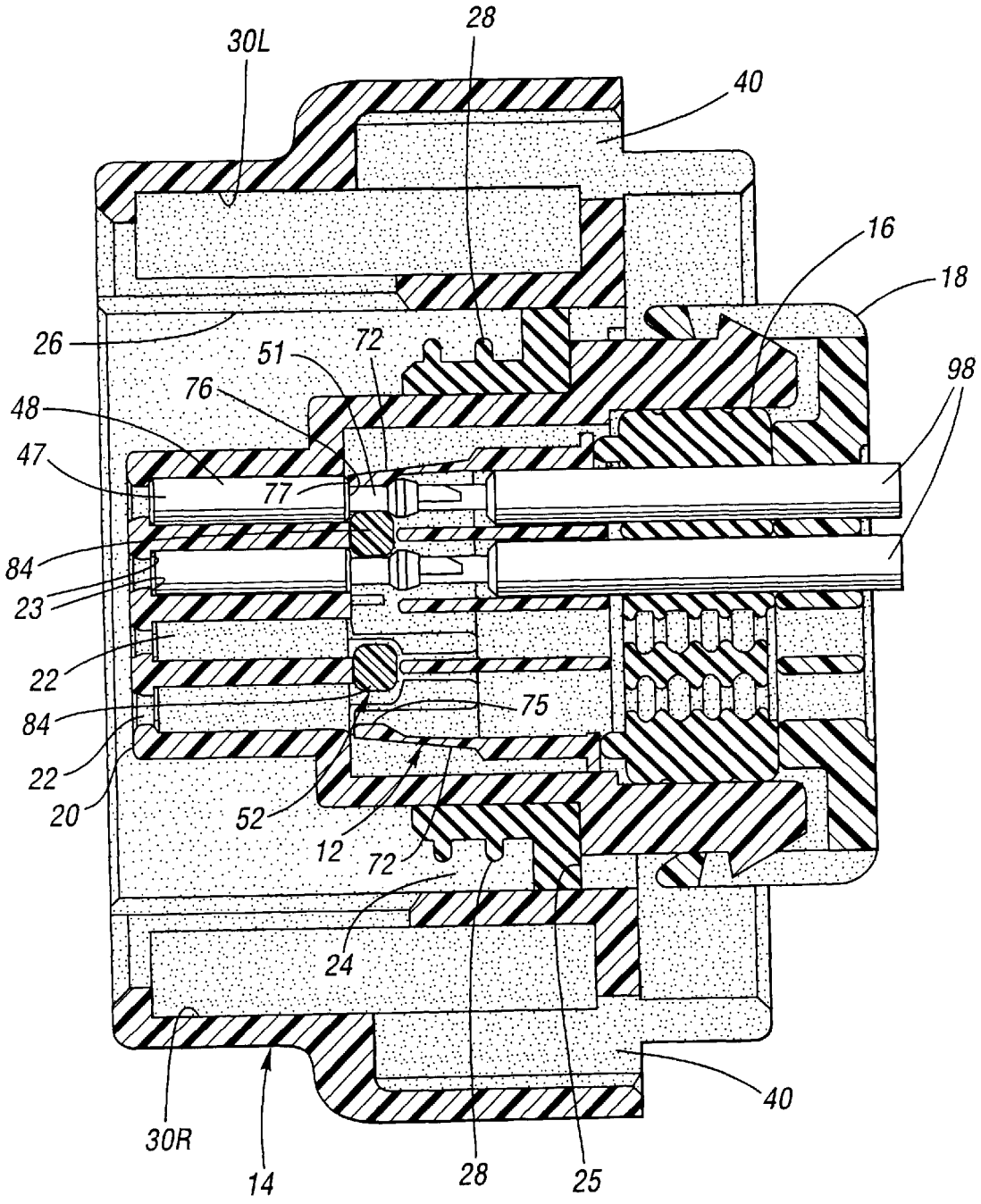
FIG. 8 is a partly sectional side view of the first connector half according to the present invention.
Figure 9:
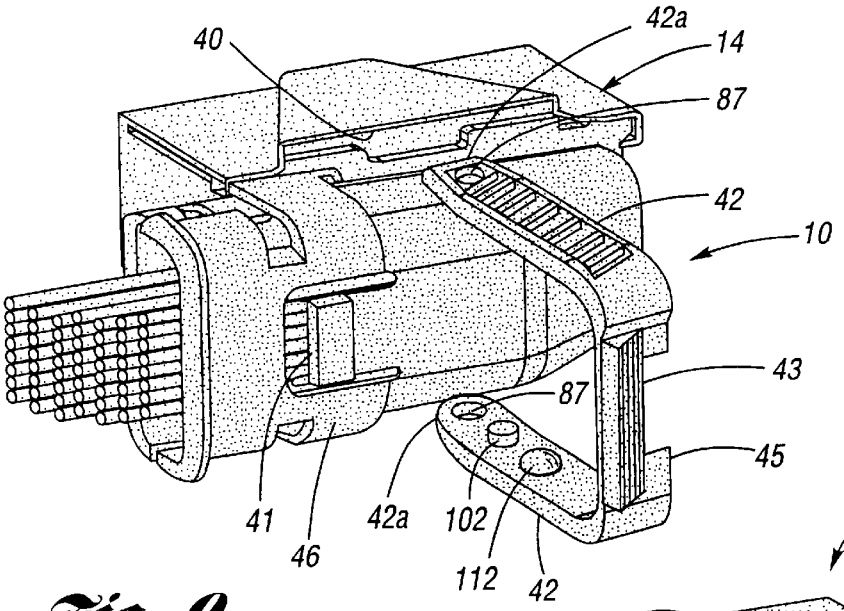
FIGS. 9 through 11 are perspective views illustrating a sequence of steps for assembling portions of the first connector half according to the present invention.
Figure 10:
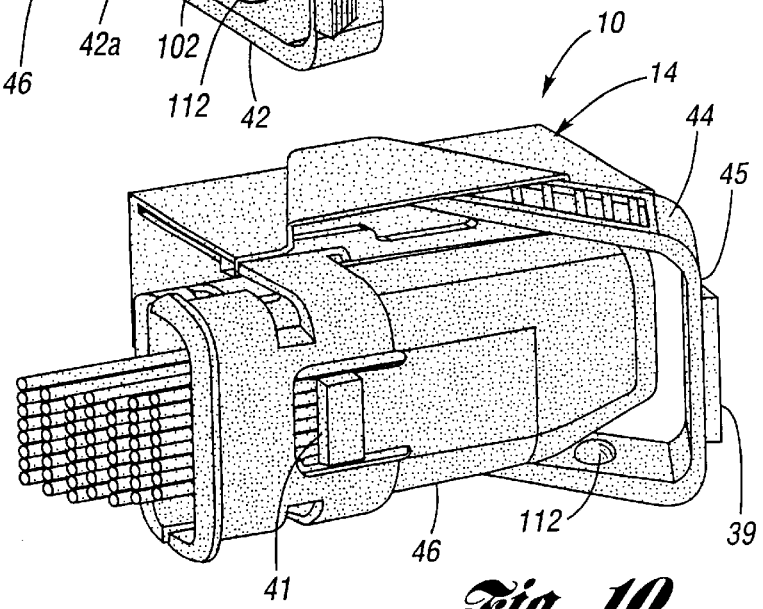

Referring now to FIGS. 1 through 11 the first connector half 10 will be described, wherein the first connector half is structured carrying, in a predetermined pattern, a plurality of electrical terminals in the preferred form of female terminals 13 (see FIGS. 2, 3 and 8).

The first connector half 10 includes a female terminal retainer 12 as a primary support and alignment feature for the female terminals 13.

Figure 13:
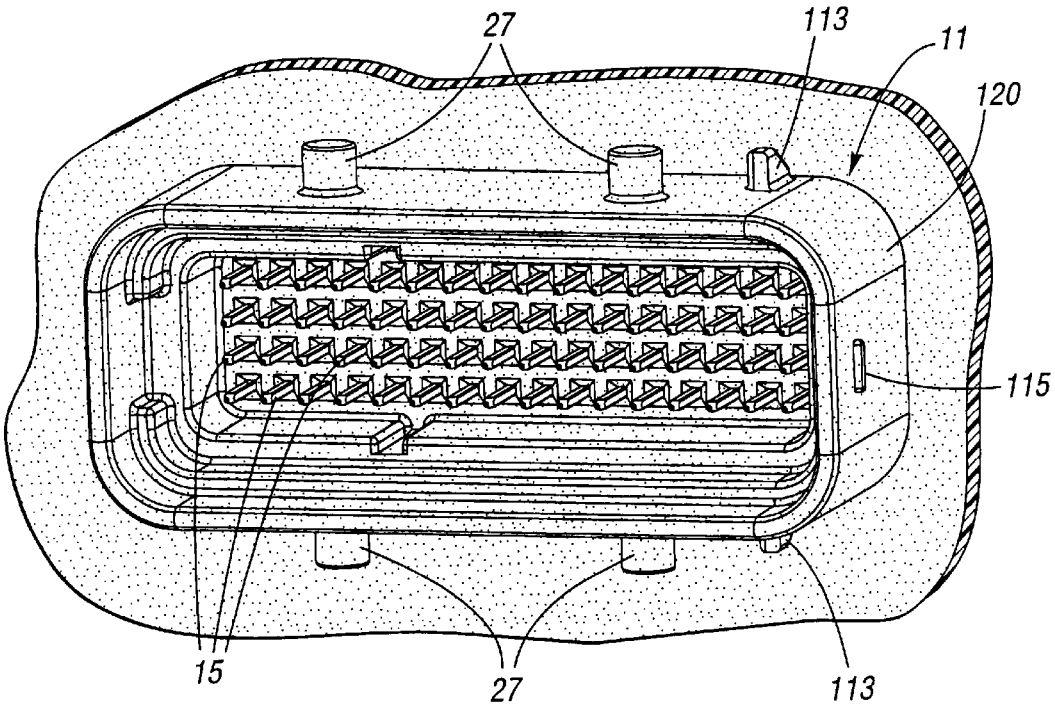
FIG. 13 is a perspective view of a second connector half of the electrical connector system according to the present invention.

As can be understood by reference to an exploded view at FIG. 1, the female terminal retainer 12 is received into a female connector housing 14, and is backed therein by an elastomeric (silicone) cable seal 16 and a cable strain relief member 18, as will be described hereinafter. The female connector housing 14 includes a main body portion 20 having a plurality of cavities 22 extending therethrough for receiving, respectively, a portion of a female terminal and a portion of male terminals 15 of the second connector half 11 (see FIG. 13). The main body portion 20 is surrounded by a channel 24 formed in the female connector housing 14 and partially defined by a first shroud 26 extending forwardly therefrom in the mating direction of the first and second connector halves 10, 11. An elastomeric (silicone) connector seal 28 is received at the base 25 of the channel 24 between the main body portion 20 and the first shroud 26.

The female connector housing 14 has left and right passages 30L, 30R formed in opposite sides of the first shroud 26, constructed and arranged so that each of the left and right passages may slidably receive therein a respective slide assist member 32L, 32R, which are mirror images of each other. Each slide assist member 32L, 32R is slid into its respective left or right passage 30L, 30R and snap fits to prevent backing out via resilient first and second locking arms 36*a*, 36*b* which abuttably interact with corresponding first and second slot perimeters 37*a*, 37*b* formed in the female connector housing 14, wherein a first pre-stage of the first connector half is defined when each first locking arm 36*a* abuts a respective first slot periphery 37*a*. Each slide assist member 32L, 32R is in the form of an elongated planar body having a pair of like shaped front and rear grooves 34, each having a perpendicular entry portion 34' and an acutely angled main portion 34", wherein the angular orientations are measured in relation to the slide axis A of the slide assist members. Each front and rear groove 34 of each slide assist member 32L, 32R is constructed and arranged to receive a respective boss 27 of the second connector half 11 (see FIG. 13) so as to assist the coupling together of the two connector halves.

The outer portion of the female connector housing 14 includes a V-shaped pocket 40 formed on opposite sides of the first shroud 26 which respectively communicate with the left and right passages 30L, 30R. Each of the pockets 40 receives a respective free end 42*a* of an arm 42 of a slide assist lever 44 which operably interconnects with the slide assist member 32L, 32R respectively thereat.

A secondary lock passage 50 is provided in the first shroud 26 for receiving a secondary lock member 52 that cooperates with the female terminal retainer 12, as will be described hereafter. A wire dress cover 46 is snap fitted to the female connector housing 14 for directing and protecting a plurality of electrical cables 98 (see FIGS. 6 through 11) electrically connected with respective female terminals 13 received in the female terminal retainer 12.

The female terminal retainer 12 has a body 54 that is generally of an elongated block configuration. The body 54 includes a rear face 56 and an opposite front face 58. A plurality of terminal cavities 60 extend therethrough from the rear face 56 to the front face 58, each being dimensioned for receiving a portion of a respective female terminal 13.

The terminal cavities are arranged in a rectilinear pattern (of rows and columns discussed hereinbelow). The cable seal 16 and the cable strain relief member 18 have cable passages 62, 64 for passage therethrough of the cables 98 associated with each of the female terminals 13. In this regard, as can be seen with reference again to FIG. 1, the cavities 22 of the main body portion 20, the terminal cavities 60 of the female terminal retainer 12, and the cable passages 62, 64 of the cable seal 16 and the cable strain relief member 18 are all mutually aligned when the first connector half 10 is assembled. The cable seal 16 is elastomeric and is received into the cable strain relief member 18, wherein the cable seal abuts the rear face 56 of the female terminal retainer 12.

At least a portion of the female terminal retainer 12 is received into a second shroud 66 of the female connector housing 14 (see FIG. 4), wherein the second shroud extends from the main body portion 20 oppositely to the first shroud 26 (see FIG. 1), that is, in a direction opposite the mating direction of the first and second connector halves 10, 11. The second shroud 66 receives the female terminal retainer 12 such that the terminal cavities 60 are aligned with the cavities 22 of the main body portion 20. The female terminal retainer 12 is able to insert only in one orientation with respect to the second shroud 66 via interference of beads 29, 31 when it is in the wrong orientation (see FIG. 4). The cable strain relief member 18 includes flexible snap locking features 68 lockable to ramp features 70 of the second shroud 66 so that when snapped thereto the cable seal 28 is compressed and the female terminal retainer 12 is firmly held to the female connector housing 14.

Referring now to FIGS. 2 though 8, a primary terminal lock system and a secondary terminal lock system of the electrical connector system 100 will each be detailed.

With regard firstly to the primary terminal lock system 19 (see FIG. 2) to retain the female terminals 13 in their respective terminal cavities 60, flexible locking fingers 72 are provided which extend from the front face 58 of the female terminal retainer 12 in the mating direction of the connector halves. Each flexible locking finger 72 straddles two mutually adjacent terminal cavities 60, and includes a pair of spaced apart locking shoulders 74 at the terminal (ie., free end) portion thereof. Each locking shoulder 74 has an intrusive surface 75 which is disposed into a portion of a respective terminal cavity and which includes a shoulder terminus 77 (see FIG. 5). Preferably, the flexible locking finger 72 has an arcuate shape, wherein a locking shoulder 74 is located at each of the two ends of the arc. As shown best at FIG. 5, each flexible locking finger 72 includes a medially located concave ramp 124.

As can be seen at FIGS. 2 and 8, each female terminal 13 is tangless, is configured to insert into a respective terminal cavity 60, and is characterized by a first portion 47 having a cylindrical sidewall 48 of a first cross-section, wherein the cylindrical sidewall defines a cylindrical cavity 49 for receiving therein a male terminal 15 (see FIG. 13) at its forward, open end. The female terminal is further characterized by a second portion 51 having a reduced cross-section as compared to the first portion 47 located distally with respect to the forward end, wherein an annular terminal abutment 76 is formed at the interface between the two dissimilar cross-sections of the first and second portions.

Figure 4:
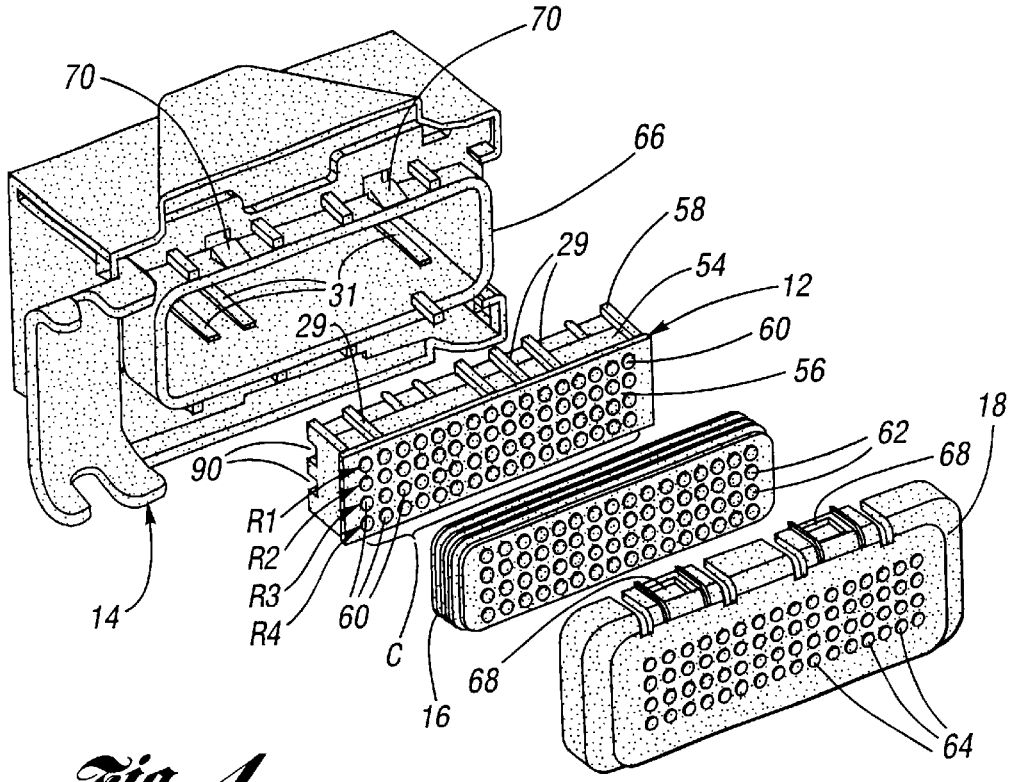
FIG. 4 is perspective exploded view of a sub-assembly of the first connector half.

As shown best at FIG. 4, in the preferred embodiment the plurality of rows and columns of terminal cavities are arranged in a rectilinear pattern composed of a first row R1, a second row R2, a third row R3, and a fourth row R4, wherein each row has a plurality of columns C (as for example sixteen columnar locations for each row).

Figure 5:
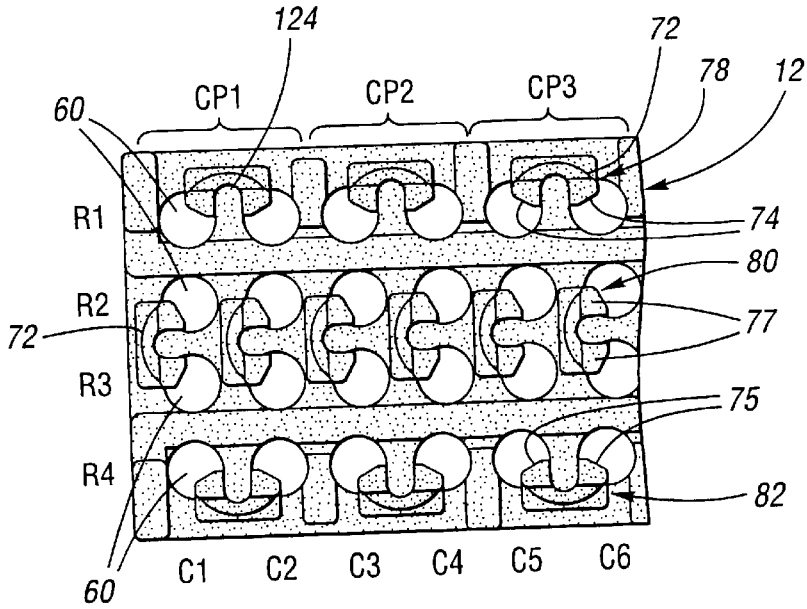
FIG. 5 is a plan view of a front face of the female terminal retainer according to the present invention.

As shown best at FIG. 5, the female terminal retainer 12 has three sets of flexible locking fingers 72, a first set 78, a second set 80 and a third set 82. The first set 78 of flexible locking fingers 72 is characterized by each locking finger thereof straddling a pair of mutually adjacent terminal cavities 60 at every columnar position pair CP1, CP2, CP3, etc. of the first row R1. The second set 80 of flexible locking fingers 72 is characterized by each locking finger thereof straddling a pair of terminal cavities 60 of the second and third rows R2, R3 having the same columnar position C1, C2, C3, C4, etc. The third set 82 of flexible locking fingers 72 is characterized, by each locking finger thereof straddling a pair of mutually adjacent terminal cavities 60 of every columnar position pair CP1, CP2, CP3, etc. of the fourth row R4.

Accordingly, when a female terminal 13 is inserted into its respective terminal cavity 60 commencing at the rear face 56, the cylindrical sidewall 48 pushes upon the intrusive surface 75 with attendant resilient deformation of the flexible locking finger 72 until the reduced cross-section portion 51 is reached, whereupon the locking finger resiliently relaxes and the shoulder terminus 77 now interferingly engages the terminal abutment 76, thereby preventing rearward withdrawal of the female terminal through the rear face of the female terminal retainer 12 (see FIG. 8).

Turning attention now to the secondary terminal lock system 21 (see FIG. 3) additional retention assurance is provided so that the female terminals 13 may not be withdrawn from the female terminal retainer 12. The secondary terminal lock system 21 utilizes a secondary lock member 52 having a plurality of elongated, somewhat flexible lock arms 84 connected together at one end by a bridge 86 having a lip 88 extending perpendicularly with respect to the lock arms 88. Each of the lock arms 84 includes a lock nub 108 near the free end (opposite the bridge 86) for engaging an edge 89 of the female terminal retainer 12, as will be discussed momentarily. Each lock arm 84 is slid into grooves 90 formed above the front face 58 of the female terminal retainer 12. Each lock arm 84 engages the terminal abutment 76 of each of the female terminals 13 at a location different from that of the shoulder terminus 77 of the flexible locking fingers 72 of the retainer, as can best be appreciated from FIG. 3.

Referring now to FIGS. 1, 6 and 7, once the female terminal retainer 12, cable seal 16, and cable strain relief member 18 are coupled to the female connector housing 14 and the wire dress cover 46 is connected to the female connector housing, the secondary lock member 52 is inserted through the secondary lock passage 50 formed in the female connector housing so that the free end of the lock arms 84 are each received into a respective groove 90. The secondary lock member 52 is sufficiently flexible so that once the bridge 86 is fully inserted through the secondary lock passage 50 the lock nubs 108 interferingly engage an edge 89 of the female terminal retainer 12 (see FIG. 7), so that the lock nubs and lip 88 are trapped on opposing sides of the main body, thereby affixing the secondary lock member 52 to the main body and to the female terminal retainer 12.

Referring now to FIG. 8, it can be seen that the flexible arms 84 of the secondary lock member 52 engage the terminal abutment 76 provided on the female terminals 13. Further, it will be seen that the cavities 22 of the main body portion 20 have a ledge 23 which traps the forward end of the female terminals 13. As can further be seen at FIG. 8, the cables 98 are in sealing engagement with the cable seal 16.

Referring now to FIGS. 1, and 9 through 11, each of the two arms 42 of the slide assist lever 44 has a hole 87 formed therethrough near the free end 42*a* thereof to receive a pivot boss 91 (see FIG. 6) formed on the female connector housing 14 inside the pocket 40. A slide assist push boss 102 is formed on the inside surface of each arm 42 of the slide assist lever 44 to be received, respectively, in a concave notch 104 formed in each slide assist member 32L, 32R for moving the slide assist members from a first (pre-staged) position of the slide assist lever (see FIG. 14) to a second (engaged) position of the slide assist lever (see FIG. 17) wherein the connector halves 10, 11 are mutually coupled together.

Figure 11:
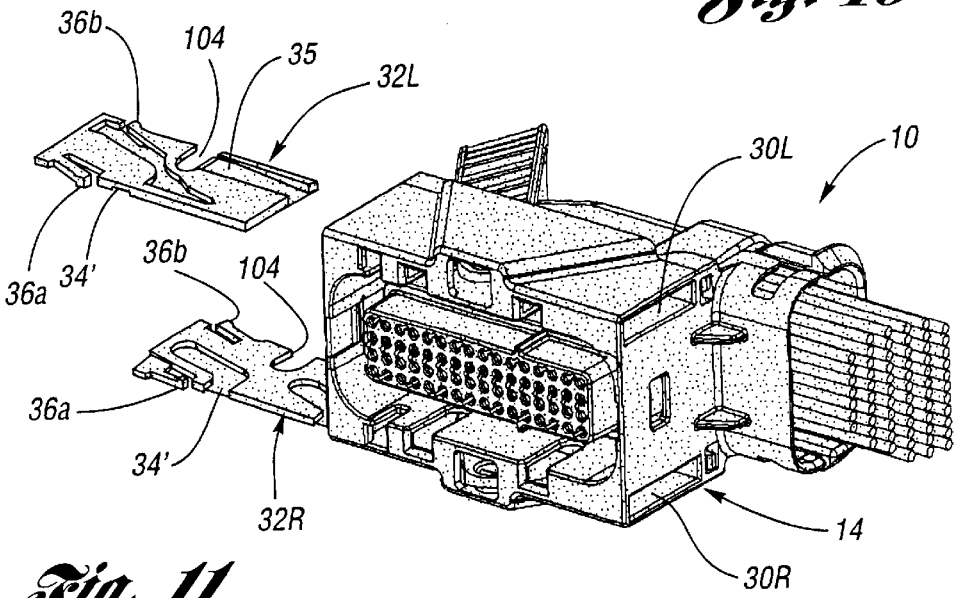

As shown at FIG. 11, in order to slidingly place the slide assist members 32L, 32R into their respective left and right passages 30L, 30R with the slide assist lever 44 already mounted on the pivot bosses 91, an inclined surface 35 is provided on each the slide assist members so as to slidably engage the slide assist push boss 102 and allow it to enter the concave notch 104 without interference in the increasing inclination direction, as shown.

Figure 14:
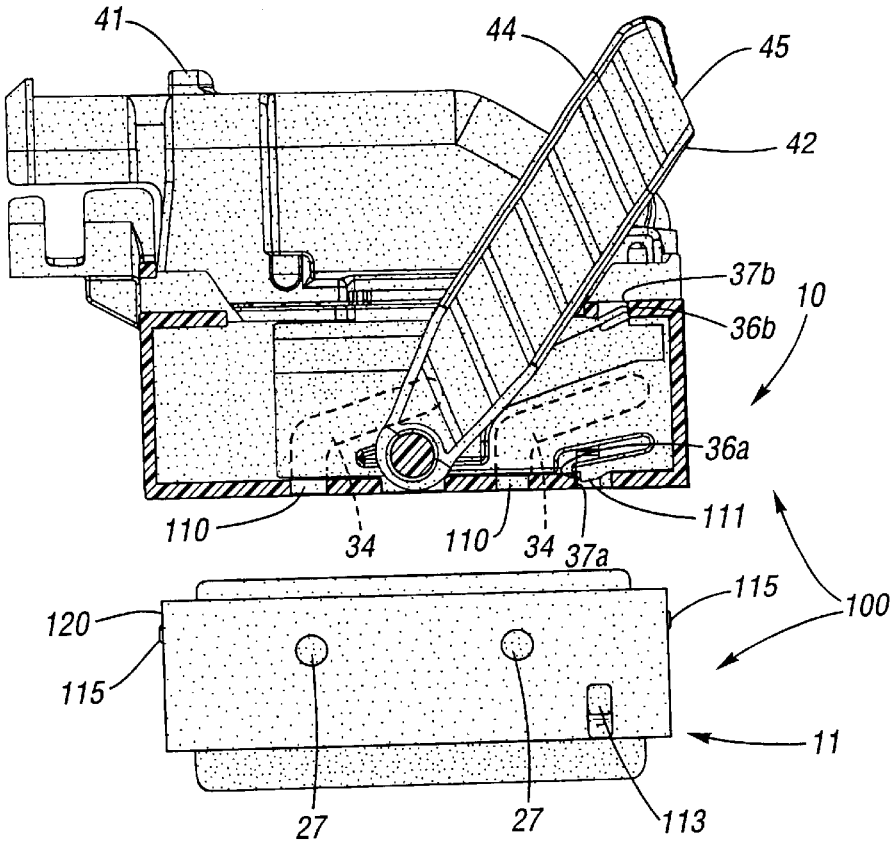
FIG. 14 is a side view of the first and second connector halves about to be mated via a slide assist system according to the present invention, wherein the first connector half is at a first pre-stage as defined by abutment of resilient locking arms.

The wire dress cover 46 and the slide assist lever 44 include mutually engaging locking elements for retaining the slide assist lever 44 in each of the first and second positions. In this regard, a convex nub 112 is provided on the inside surface of each of the arms 42 of the slide assist lever for fractional engagement with a concavely shaped shoulder 116 formed in the wire dress cover 46 (see FIG. 16) so as to lightly retain the slide assist lever at the first position, as shown at FIG. 14, and at the second position, as shown at FIG. 17.

As shown at FIGS. 9, 10, 12 and 14 through 17, in order to firmly retain the slide assist lever 44 at the second (engaged) position, the bar 45 which connects the two arms 42 is provided with a lip 43 which engages a resiliently mounted boss 41 of the wire dress cover 46. A ridged finger grip 39 is provided on the bar 45 for facilitating hand-operated engagement of the lip 43 onto the boss 41 when the slide assist lever 44 is finally brought to the second position.

Referring now to FIGS. 14 through 17, the operation of the slide assist system of the electrical connector system 100 will be detailed.

As indicated earlier with reference to FIG. 1, the slide assist members 32L, 32R each have front and rear grooves 34 having a perpendicular entry portion 34' and an angled main portion 34", wherein the angular orientation, as mentioned, is defined by the slide axis A of the slide assist members. When the slide assist lever 44 is at the first (pre-staged) position of FIG. 14, the entry portion 34' of each groove 34 is aligned with a respective primary slot 110 formed in the first shroud 26 of the female connector housing 14 (see FIG. 6). Each primary slot 110 is constructed and arranged so that its respective boss 27 on the second connector half 11 is received thereinto as the second connector half is seated into the first connector half 10. The female connector housing 14 further has a pair of first slots 111 (each having the aforementioned first slot periphery 37*a*) at one end of the first shroud 26 (see FIG. 6) which respectively receive tabs 113 of the second connector half 11 (see FIG. 13) so as to thereby ensure proper alignment of the second connector half with respect to the first connector half 10.

FIG. 14 depicts the first connector half 10 at a first pre-stage. The first pre-stage is defined by the first locking fingers 36*a* of the slide assist members 32L, 32R abutting their respective first slot peripheries 37*a*, thereby preventing the slide assist members from sliding, and, consequently, preventing the slide assist lever 44 from pivoting out of its first (pre-staged) position. The first pre-stage ensures the aforementioned alignment of the bosses 27 with the entry portions 34' of the groove 34 will be present when the first and second connector halves 10, 11 are to be mated, as shown at FIG. 14.

With the first connector half 10 at the first pre-stage, a third shroud 120 of the second connector half 11 begins to seat (as for example by manually pressing the second connector half receivably into the first connector half) into the first shroud 26 of the first connector half 10 in the mating direction, wherein the tabs 113 are aligned with the secondary slots 111 and the bosses 27 are aligned with the primary slots 110. As the second connector half 11 seats into the first connector half 10, front and rear nibs 115 of the third shroud 120 (of the second connector half 11) pass along a groove 122 formed at opposing ends of the first shroud 24 (of the female connector housing 14) until they engage lips 117 projecting with respect to the grooves 122. The lips 117 are respectively located adjoining the secondary lock passage 50 and an auxiliary passage 53 (see FIGS. 6, 15A and 15B). When the second connector half 11 is at an intermediate seating relative to the first connector half, defined when the nibs 115 snappingly engage the lips 117, the first and second connector halves are at a second pre-stage, whereat the first and second connector halves are held from separating.

Figure 15A:
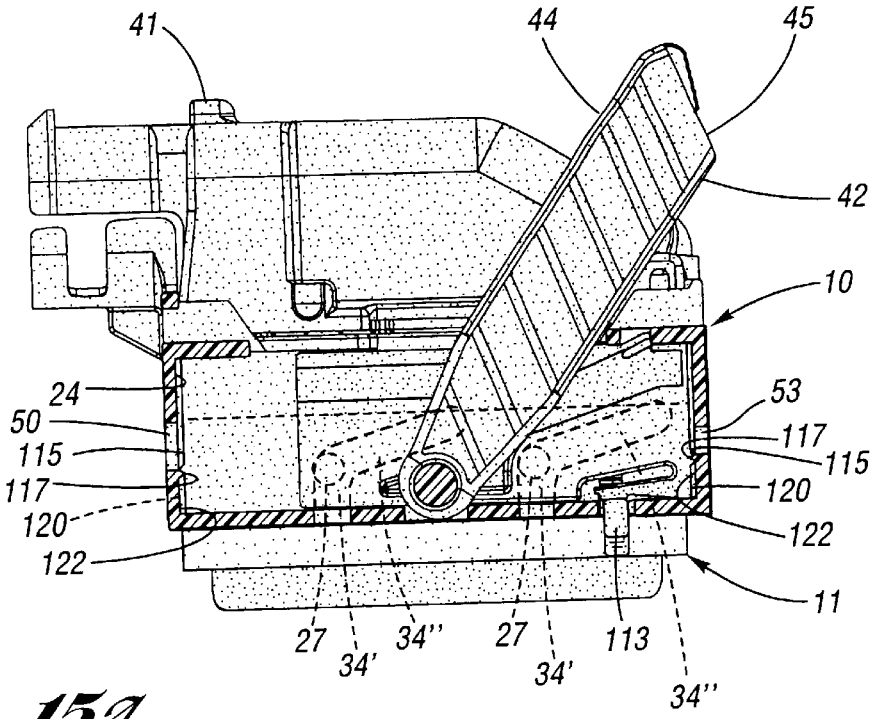
FIG. 15A is a side view of the first and second connector halves being mated via the slide assist system, wherein the first connector half is no longer at the first pre-stage and the first and second connector halves are now a second pre-stage.
Figure 15B:
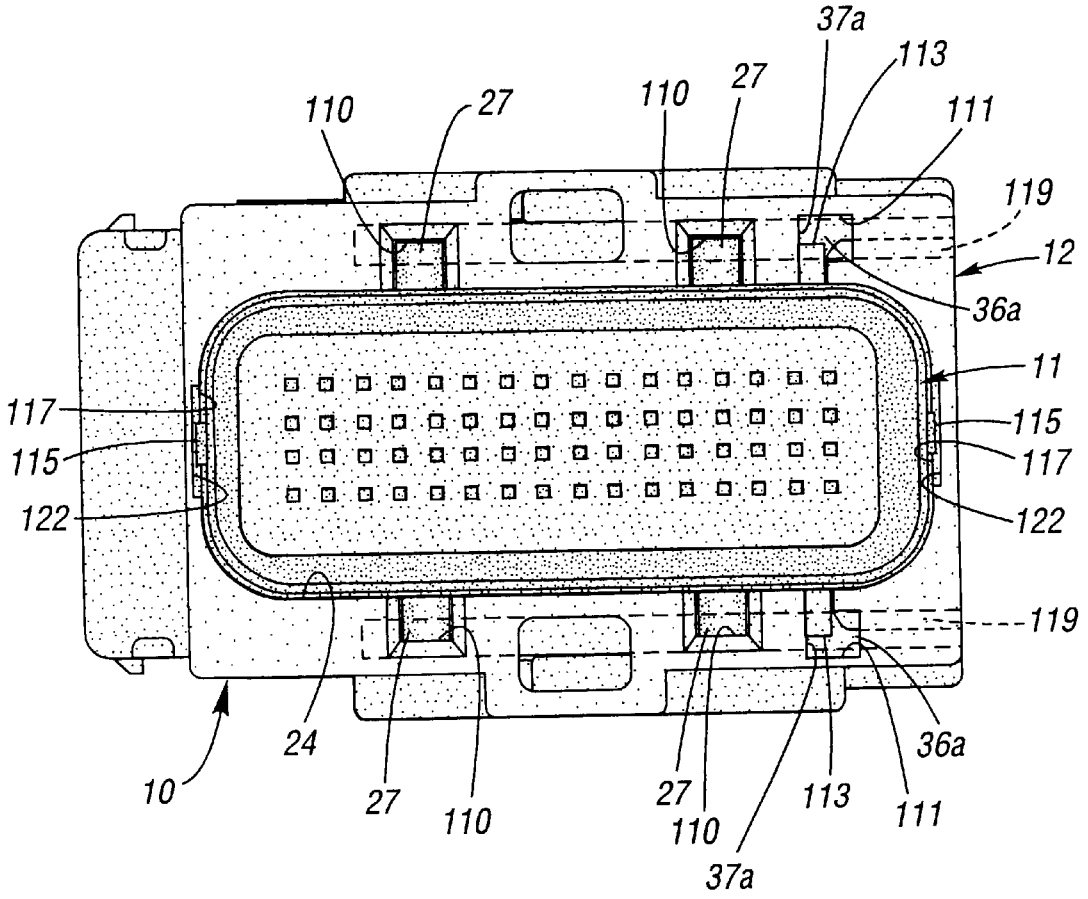
FIG. 15B is a bottom plan view of the first and second connector halves, in the relative position depicted at FIG. 15A.

Referring now to FIGS. 15A and 15B, the second pre-stage is shown, wherein the third shroud 120 is intermediately seated into the female connector housing 14 via the channel 24. The bosses 27 have passed through the primary slots 110, entered into the entry portion 34' of the grooves 34 and are now stopped at the main portion 34". As the third shroud 120 seated into the channel 24, the tabs 113 pressed upon the first locking arms 36*a*, causing them to flex. At the intermediate seating (of the second pre-stage), the first locking arms 36*a* are flexed sufficiently so as to be out of interfering abutment with the first slot periphery 37*a* of each of the secondary slots 111. Now, at the second pre-stage, the slide assist lever 44 may be pivoted to actuate the slide assist system to thereby further seat the second connector half into the first connector half (any further need for manual pressing of the second connector half into the first connector half being obviated).

Figure 16:
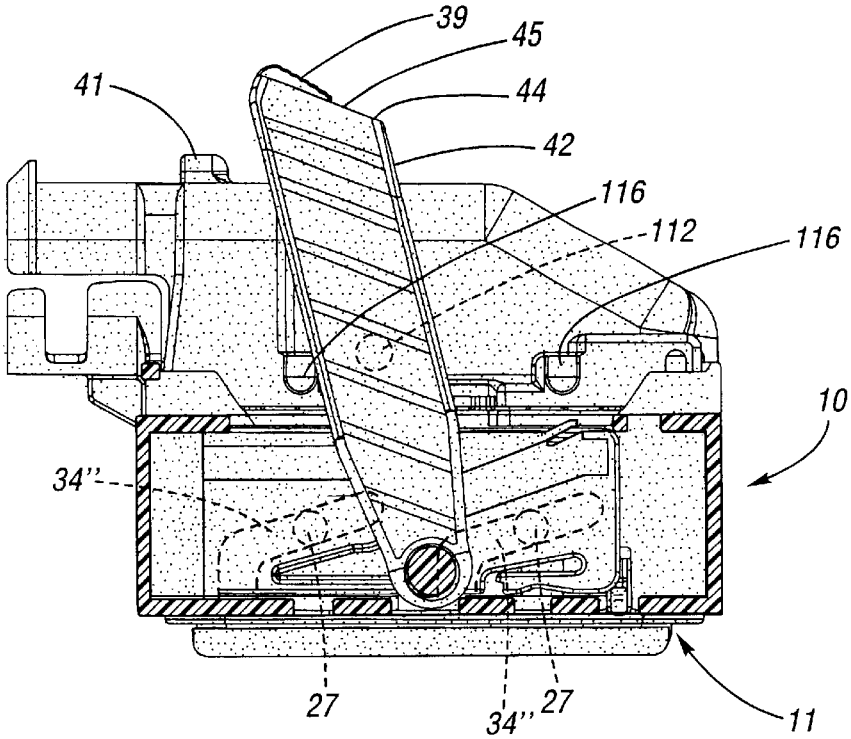
FIGS. 16 and 17 are side views of the first and second connector halves being progressively further mated by operation of the slide assist system.
Figure 17:
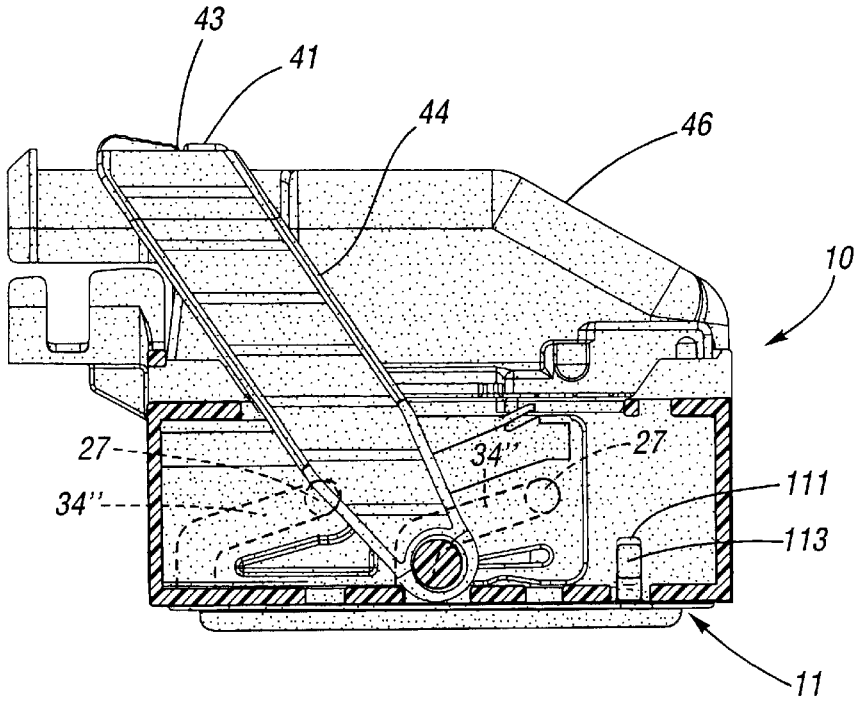

As shown at FIG. 16, the slide assist lever 44 is pivoted from the first position toward the second position, whereupon the slide assist members 32L, 32R slide therewith from a first location (FIG. 15A) toward a second location (FIG. 17), thereby causing the bosses 27 to be forced to slide guidably along the angled main portion 34" of the grooves 34, and thereby causing the second connector half 11 to further seat into the first connector half 10 and cause the male terminals 15 to enter into the cavity 49 of respective female terminals 13. As the slide assist members 32L, 32R slide and the second connector half 11 is further seated into the first connector half, each of the tabs 113 enter into a respective recess 119 of the slide assist members (see FIG. 15B).

As shown at FIG. 17, the slide assist lever 44 is now at the second (engaged) position, whereupon the boss 41 of the wire dress cover 46 is snapped onto the lip 43 of the slide assist lever and the second connector half 11 is fully seated with the first connector half 10. At this position, the male and female terminals 15, 13 are properly electrically engaged with each other.

From the foregoing description, it will be appreciated that the use of a dual lock design as described above allows a single flexible locking finger to lock around a pair of tangless female terminals having no required pre-orientation, which are mutually spaced on very close center lines (as for example 2.54 mm.) for increased electrical density. Given this tight center line, the dual lock design allows the flexible locking finger to be much stronger than would be smaller locking fingers independently assigned for each female terminal. Thus, the dual lock arrangement is strong enough to allow the use of existing, reliable, and cost-effective harness manufacturing processes in the conjunction with a round non-oriented tangless female terminal package on numerous rows of 2.54 mm by 2.54 mm center lines. Also, the locking fingers provide enough surface between each adjacent pair of terminals for an elongated, thin shafted repair tool to pass through a selected access port 126 so as to flex a locking finger at the ramp 124 to release the female terminals held thereby when desired (two smaller locking fingers independently for two female terminals on 2.54 mm center lines would not have enough room to accomplish this repair method). Further, the dual lock design allows numerous rows of terminals to be spaced on 2.54 mm center lines, yet still leave space for the secondary lock member 52.

To those skilled in the art to which this invention appertains, the above described preferred embodiment may be subject to change or modification. Such change or modification can be carried out without departing from the scope the invention, which is intended to be limited only by the scope of the appended claims.

What is claimed is:

1. A terminal retainer comprising:

a body having a front face and an opposite rear face, said body having a plurality of terminal cavities formed therethrough between said front and rear faces, wherein said plurality of terminal cavities are arranged in a predetermined pattern of pairs of adjacent terminal cavities; and a plurality of resilient locking fingers integrally connected with said front face and extending therefrom in an orientation generally parallel to said plurality of terminal cavities, wherein each locking finger of said plurality of locking fingers straddles a respective pair of adjacent terminal cavities;

wherein each locking finger of said plurality of locking fingers comprises a pair of mutually spaced apart locking shoulders, wherein each locking shoulder of each locking finger is resiliently disposed into a respective terminal cavity of the terminal cavity pair straddled by the respective locking finger.

2. The terminal retainer of claim 1, wherein each terminal cavity of each terminal cavity pair is separated from each other by substantially 2.54 millimeters on center.

3. The terminal retainer of claim 1, wherein each locking shoulder terminates at a terminus, each terminus being located at a common plane; said terminal retainer further comprising:

at least one groove formed at said front face and located adjacent said plurality of terminal cavities; and at least one arm receivable into said at least one groove;

wherein when said at least one arm is received in said at least one groove, said at least one arm has a surface located at said common plane.

4. The terminal retainer of claim 3, wherein said plurality of terminal cavities is arranged in a rectilinear pattern comprising a first row, a second row, a third row, and a fourth row, wherein each of said first, second, third and fourth rows has a plurality of columns, and wherein said plurality of columns defines a sequence of columnar positions and pairs of columnar positions; and wherein said plurality of locking fingers comprises a first set, a second set and a third set, wherein the first set comprises each locking finger thereof straddling a pair of mutually adjacent terminal cavities at every columnar position pair of the first row, the second set comprises each locking finger thereof straddling a pair of terminal cavities of the second and third rows having the same columnar position, and the third set comprises each locking finger thereof straddling a pair of mutually adjacent terminal cavities of every columnar position pair of the fourth row; and wherein said at least one arm comprises a pair of arms connected together by a bridge, wherein said at least one groove comprises a first groove located between said first and second rows and a second groove located between said third and fourth rows; and wherein said pair of arms is received by said first and second grooves.

5. The terminal retainer of claim 4, wherein each terminal cavity of each terminal cavity pair is separated from each other by substantially 2.54 millimeters on center.

6. An electrical connector system comprising:

a terminal retainer comprising a body having a front face and an opposite rear face, said body having a plurality of terminal cavities formed therethrough between said front and rear faces, and a plurality of resilient locking fingers integrally connected with said front face and extending therefrom in an orientation generally parallel to said plurality of terminal cavities, wherein said plurality of terminal cavities are arranged in a predetermined pattern of pairs of adjacent terminal cavities, and wherein each locking finger of said plurality of locking fingers straddles a respective pair of adjacent terminal cavities; and a plurality of first terminals comprising a first portion, a second portion, and an annular terminal abutment located between said first and second portions;

wherein each locking finger of said plurality of locking fingers comprises a pair of mutually spaced apart locking shoulders, wherein each locking shoulder of each locking finger is resiliently disposed into a respective terminal cavity of the terminal cavity pair straddled by the respective locking finger, wherein each locking shoulder terminates at a terminus and, wherein each terminus is located at a common plane; and wherein when a selected first terminal is inserted into a selected terminal cavity from the rear face of the terminal retainer, the terminal abutment thereof interferingly abuts the terminus of the locking shoulder of the locking finger straddling the selected terminal cavity so as to prevent the selected first terminal from withdrawing from the terminal retainer at said rear face thereof.

7. The connector system of claim 6, wherein each terminal cavity of each terminal cavity pair is separated from each other by substantially 2.54 millimeters on center.

8. The connector system of claim 6, further comprising a secondary lock system comprising:

at least one groove formed at said front face and located adjacent said plurality of terminal cavities; and at least one arm receivable into said at least one groove;

wherein when said at least one arm is received in said at least one groove, said at least one arm has a surface located at said common plane which interferingly abuts the terminal abutment of each first terminal.

9. The connector system of claim 8, wherein said plurality of terminal cavities is arranged in a rectilinear pattern comprising a first row, a second row, a third row, and a fourth row, wherein each of said first, second, third and fourth rows has a plurality of columns, and wherein said plurality of columns defines a sequence of columnar positions and pairs of columnar positions; and wherein said plurality of locking fingers comprises a first set, a second set and a third set, wherein the first set comprises each locking finger thereof straddling a pair of mutually adjacent terminal cavities at every columnar position pair of the first row, the second set comprises each locking finger thereof straddling a pair of terminal cavities of the second and third rows having the same columnar position, and the third set comprises each locking finger thereof straddling a pair of mutually adjacent terminal cavities of every columnar position pair of the fourth row; and wherein said at least one arm comprises a pair of arms connected together by a bridge, wherein said at least one groove comprises a first groove located between said first and second rows and a second groove located between said third and fourth rows; and wherein said pair of arms is received by said first and second grooves.

10. The connector system of claim 6, further comprising:

a first connector half comprising a housing including a main body having a plurality of cavities, and means for holding said terminal retainer to said main body wherein the plurality of terminal cavities is aligned with the cavities of the main body so that said plurality of first terminals is received therein;

a second connector half, wherein said second connector half is seatable into said first connector half;

a slide assist system for assisting seating said second connector half into said first connector half, said slide assist system comprising a plurality of bosses located on said second connector half, and slide assist member means slidably mounted to said housing for engaging said plurality of bosses and forcing said second connector half to inceasingly seat into said second connector half as said slide assist member means is slidably moved with respect to said housing from a first location to a second location along a slide axis; and first pre-stage means for retaining said slide assist member means at said first location until said second connector half is at a preselected intermediate seating into said first connector half.

11. The connector system of claim 10, further comprising second pre-stage means for restraining said second connector half from separating from said first connector half when said second connector half reaches said preselected intermediate seating.

12. The connector system of claim 11, further comprising lever means pivotally connected with said housing for causing said slide assist member means to slide from said first location to said second location in response to said lever being pivoted from a first position to a second position relative to said housing.

13. The connector system of claim 12, wherein said slide assist member means comprises a pair of slide assist members, each slide assist member having a plurality of grooves, one groove, respectively, for each boss of said plurality of bosses, wherein each groove comprises an entry portion for receiving a boss and a main portion for guiding movement of the boss, wherein the entry portion is oriented perpendicular to the slide axis and wherein the main portion is acutely angled with respect to the slide axis;

wherein as said slide assist members slide from the first location to the second location, each boss moves guidably in its respective main portion, wherein the acute angle thereof forces said second connector half to become fully seated into said first connector half when said lever means is fully pivoted to the second position.

14. The connector system of claim 13, wherein said first pre-stage means comprises:

a resilient locking arm formed on each slide assist member; and a pair of slot peripheries formed in said housing;

wherein at said first pre-stage, each locking arm is interferingly abutted against a respective slot periphery, thereby preventing its respective slide assist member from sliding from the first location toward the second location.

15. The connector system of claim 14, further comprising tab means on said second connector half for flexing each said locking arm out of abutment with its respective slot periphery when said second connector half is at the preselected intermediate seating, whereupon each slide assist member is slidable from the first location toward the second location.

16. The connector system of claim 15, further comprising a secondary lock system comprising:

at least one groove formed at said front face and located adjacent said plurality of terminal cavities; and at least one secondary lock arm receivable into said at least one groove;

wherein when said at least secondary lock one arm is received in said at least one groove, said at least one secondary lock arm has a surface located at said common plane which interferingly abuts the terminal abutment of each first terminal.

17. The connector system of claim 16, wherein said plurality of terminal cavities is arranged in a rectilinear pattern comprising a first row, a second row, a third row, and a fourth row, wherein each of said first, second, third and fourth rows has a plurality of columns, and wherein said plurality of columns defines a sequence of columnar positions and pairs of columnar positions; and wherein said plurality of locking fingers comprises a first set, a second set and a third set, wherein the first set comprises each locking finger thereof straddling a pair of mutually adjacent terminal cavities at every columnar position pair of the first row, the second set comprises each locking finger thereof straddling a pair of terminal cavities of the second and third rows having the same columnar position, and the third set comprises each locking finger thereof straddling a pair of mutually adjacent terminal cavities of every columnar position pair of the fourth row; and wherein said at least one secondary lock arm comprises a pair of secondary lock arms connected together by a bridge, wherein said at least one groove comprises a first groove located between said first and second rows and a second groove located between said third and fourth rows; and wherein said pair of secondary lock arms is received by said first and second grooves.

18. The connector system of claim 17, wherein each terminal cavity of each terminal cavity pair is separated from each other by substantially 2.54 millimeters on center.

19. An electrical connector system comprising:

a terminal retainer comprising a body having a front face and an opposite rear face, said body having a plurality of terminal cavities formed therethrough between said front and rear faces, and a plurality of resilient locking fingers integrally connected with said front face and extending therefrom in an orientation generally parallel to said plurality of terminal cavities, wherein said plurality of terminal cavities are arranged in a predetermined pattern of pairs of adjacent terminal cavities, and wherein each locking finger of said plurality of locking fingers straddles a respective pair of adjacent terminal cavities;

a plurality of first terminals comprising a first portion, a second portion, and an annular terminal abutment located between said first and second portions;

a first connector half comprising a housing including a main body having a plurality of cavities, and means for holding said terminal retainer to said main body wherein the plurality of terminal cavities is aligned with the cavities of the main body so that said plurality of first terminals is received therein;

a second connector half for carrying a plurality of second terminals, wherein said plurality of first terminals is matable, respectively, with said plurality of second terminals when said second connector half is seated into said first connector half; and slide assist system means for assisting seating of said second connector half into said first connector half so that said plurality of first terminals are mated, respectively, to said plurality of second terminals, said slide assist system means comprising:

a plurality of bosses located on said second connector half; and slide assist member means slidably mounted to said housing for engaging said plurality of bosses and forcing said second connector half to progressively seat into said first connector half as said slide assist member means is slidably moved along a slide axis with respect to said housing;

wherein each locking finger of said plurality of locking fingers comprises a pair of mutually spaced apart locking shoulders, wherein each locking shoulder of each locking finger is resiliently disposed into a respective terminal cavity of the terminal cavity pair straddled by the respective locking finger, wherein each locking shoulder terminates at a terminus and, wherein each terminus is located at a common plane; and wherein when a selected first terminal is inserted into a selected terminal cavity from the rear face of the terminal retainer, the terminal abutment thereof interferingly abuts the terminus of the locking shoulder of the locking finger straddling the selected terminal cavity so as to prevent the selected first terminal from withdrawing from the terminal retainer at said rear face thereof.

20. The connector system of claim 19, further comprising a secondary lock system comprising:

at least one groove formed at said front face and located adjacent said plurality of terminal cavities; and at least one arm receivable into said at least one groove;

wherein when said at least one arm is received in said at least one groove, said at least one arm has a surface located at said common plane which interferingly abuts the terminal abutment of each first terminal.

21. The connector system of claim 20, wherein each terminal cavity of each terminal cavity pair is separated from each other by substantially 2.54 millimeters on center.

* * * * *